US009095764B2

(12) United States Patent
Mete

(10) Patent No.: US 9,095,764 B2
(45) **Date of Patent: *Aug. 4, 2015**

(54) SKATEBOARD AND SKATEBOARD TRUCK

(71) Applicant: SkateOne Corp., Goleta, CA (US)

(72) Inventor: Michael T. Mete, Santa Barbara, CA (US)

(73) Assignee: SkateOne Corp., Goleta, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/107,674

(22) Filed: Dec. 16, 2013

(65) Prior Publication Data

US 2014/0306411 A1 Oct. 16, 2014

Related U.S. Application Data

(63) Continuation of application No. 13/326,944, filed on Dec. 15, 2011, now Pat. No. 8,608,182.

(51) Int. Cl.

| | |
|---|---|
| ***B62M 1/00*** | (2010.01) |
| ***A63C 17/00*** | (2006.01) |
| ***A63C 17/01*** | (2006.01) |

(52) U.S. Cl.

CPC ..... *A63C 17/0093* (2013.01); *A63C 17/012* (2013.01); *A63C 17/015* (2013.01); *Y10T 29/49826* (2015.01)

(58) Field of Classification Search

CPC ..... A63C 1/00; A63C 17/00

USPC ..... 280/11.27, 11.28, 11.19, 87.042, 280/87.041, 87.03

See application file for complete search history.

(56) References Cited

U.S. PATENT DOCUMENTS

| | | | | |
|---|---|---|---|---|
| 2,233,355 | A | 2/1941 | Ware | |
| 2,330,338 | A * | 9/1943 | Dekome et al. | 280/11.28 |
| 2,560,017 | A * | 7/1951 | Ware | 280/11.28 |
| 2,606,768 | A * | 8/1952 | Wagner | 280/11.28 |
| 4,103,917 | A * | 8/1978 | Widolf | 280/11.28 |
| 4,278,264 | A * | 7/1981 | Lenz | 280/11.28 |
| 4,623,159 | A | 11/1986 | Grenko | |
| 5,029,882 | A | 7/1991 | Marandel | |
| 6,182,987 | B1 * | 2/2001 | Bryant | 280/87.042 |
| 6,367,819 | B1 * | 4/2002 | Andersen et al. | 280/11.28 |
| 6,474,666 | B1 * | 11/2002 | Andersen et al. | 280/87.041 |
| 6,981,710 | B2 | 1/2006 | Cheng | |
| 7,080,845 | B2 * | 7/2006 | Inchley | 280/87.042 |
| 7,104,598 | B2 * | 9/2006 | Wingen | 296/216.03 |
| 7,287,762 | B2 * | 10/2007 | Stratton | 280/11.27 |
| 7,722,060 | B1 | 5/2010 | Clark | |
| 7,828,306 | B2 * | 11/2010 | Stratton | 280/87.042 |
| 8,246,058 | B2 | 8/2012 | Wang et al. | |
| 8,608,182 | B2 * | 12/2013 | Mete | 280/11.27 |

* cited by examiner

*Primary Examiner* — Hau Phan

(74) *Attorney, Agent, or Firm* — Cooley LLP

(57) ABSTRACT

Devices and methods for lowering the center of gravity of a skateboard, while maintaining the structural integrity of the deck are described herein. In some embodiments, a skateboard includes a deck, a pair of trucks, and a set of bearings and wheels. The deck can include a cutout configured to receive a portion of the truck. The trucks are configured to couple to a bottom surface of the deck and include a portion disposed within the opening of the deck.

20 Claims, 10 Drawing Sheets

SKATEBOARD AND SKATEBOARD TRUCK

CROSS-REFERENCE TO RELATED APPLICATIONS

This application is a continuation of U.S. patent application Ser. No. 13/326,944, entitled "Skateboard and Skateboard Truck," filed Dec. 15, 2011, the entirety of which is incorporated herein by reference.

BACKGROUND

The embodiments described herein relate generally to the trucks of a skateboard. More particularly, the embodiments described herein relate to a skateboard truck configured to lower the center of gravity and improve the ride quality of a skateboard.

Skateboards are a known means of activity and transportation. Standard skateboards generally include a deck, a pair of trucks, and a set of bearings and wheels. Various skateboard designs exist and are generally configured to tailor to a particular riding style or function. For example, a longboard is used as a means of transportation or "cruising" due to the fluidity of motion.

Often, the deck of a longboard ranges in length between 33 in. to 59 in. and can define various shapes and configurations. For example, a pintail design includes a deck with a teardrop shape configured to allow room for the wheels to spin freely without contacting the bottom surface of the deck. As such, the trucks can be mounted to the bottom surface of the deck and thus, the pintail design defines a relatively high center of gravity. In some instances, the relatively high center of gravity can lead to instability.

In other instances, the longboard can include a drop through truck design. With this design, the center of gravity is lower than the design in which the trucks are mounted to the bottom surface of the deck. The drop through design is configured such that the mounting plate of the trucks is secured to the top surface of the deck and the other components of the trucks (e.g., the pivot cup, kingpin, hanger, bushings, etc.) extend through a cutout portion of the deck. While the lowered center of gravity provides the rider with more stability, the cutouts in the deck result in relatively large stress concentration risers. The presence of stress concentration risers can lead to cracks or splits in the deck propagating from the stress concentration risers. In some instances, the cracks or splits can lead to a catastrophic failure of the deck (e.g., the deck breaks into multiple pieces) under a load (e.g., the force applied by the weight of the rider). Additionally, the securing of the mounting plates of the trucks to the top surface of the deck results in the bolts being in tension when under the load of the rider. The constant tensile force can cause the nuts to work loose from the bolt, resulting in the mounting of the trucks to the deck to loosen.

FIGS. 1 and 2 illustrate a skateboard in a known configuration. In such a known configuration, a skateboard 100 includes a deck 110, a pair of trucks 130, and a set of wheels 150. The skateboard 100 can be, for example, a longboard skateboard with a "drop through" truck configuration. In such configurations, the trucks 130 include a base plate and a hanger. The hanger is coupled to the base plate in a known configuration. The base plate mounts to a top surface 117 of the deck 110 at a mounting location 113. In this manner, the hanger extends through an opening 115 from the top surface 117 through to the bottom surface 118. In such a configuration, the distance from the base plate to the center of the axle is approximately 62.4 mm.

The openings 115 are a given shape such that the base plate mounts to the top surface 117 of the deck 110 and the hanger 130 extends through the opening 115. As shown in FIG. 2, the opening 115 defined by the deck 110 is a large opening configured to receive the entirety of hanger of the truck 130 therethrough. In such known configurations, the opening 115 defines a discontinuity in the deck 110 and thus defines stress concentration risers inherent in a discontinuity. As used herein, a stress concentration riser is any given geometry, discontinuity, cutout, and/or the like, that increases the stress of a given material at a given location. The opening 115 includes relatively large stress concentration risers due to the size and/or geometry of the opening 115 through which the trucks 130 are mounted. Such stress concentration risers can lead to cracks propagating from the location of the stress concentration riser, such as, the small radius corners of the opening 115, and can result in the deck cracking and/or breaking to the point of being unusable.

Thus, a need exists for improved methods and devices for lowering the center of gravity and improving ride quality of a skateboard, while maintaining the structural integrity of the deck.

SUMMARY

Devices and methods for lowering the center of gravity of a skateboard, while maintaining the structural integrity of the deck are described herein. In some embodiments, a skateboard includes a deck, a pair of trucks, and a set of bearings and wheels. The deck can include a relatively small cutout configured to receive a portion of the truck. The trucks are configured to couple to a bottom surface of the deck and include a portion disposed within the opening of the deck.

DETAILED DESCRIPTION

In some embodiments, a skateboard includes a deck, a pair of trucks, and a set of bearings and wheels. The deck can include a cutout or opening configured to receive a portion of the truck, for example, a pivot cup included in a base plate or mounting portion of the truck. The trucks are configured to couple to a bottom surface of the deck and include a portion, for example, the pivot cup, configured to protrude through the opening of the deck.

In some embodiments, a skateboard includes a deck, a pair of trucks, and a set of bearings and wheels. The trucks include a base plate configured to couple the trucks to the deck. The trucks further include a hanger pivotally disposed within a pivot cup. A bushing is disposed within an opening defined by the pivot cup and is configured to selectively engage a portion of the hanger such that vibration transferred to the deck is reduced.

Figure 1:
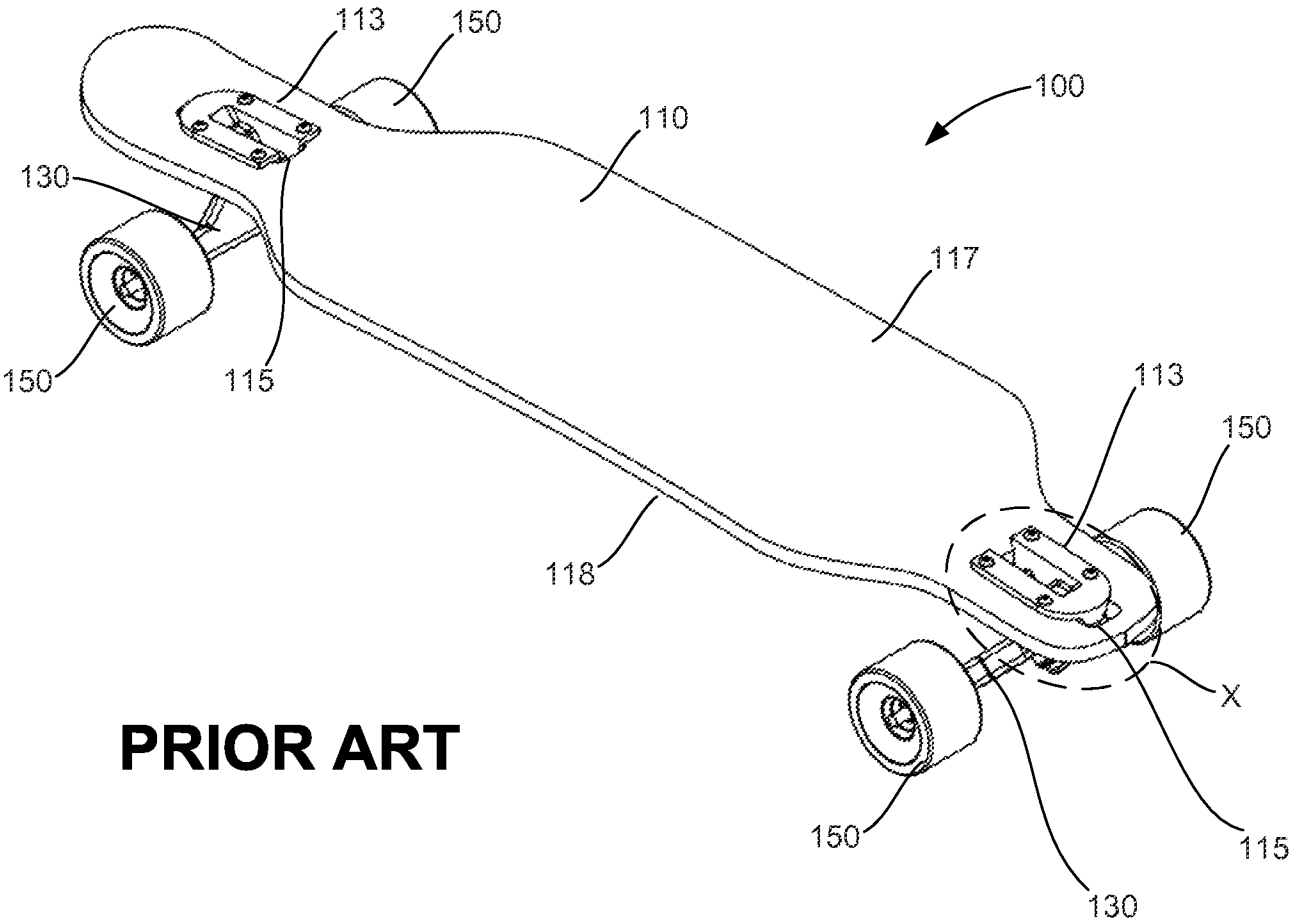
PRIOR ART FIG. 1
FIG. 1 is a perspective view of a known skateboard configuration.
Figure 2:
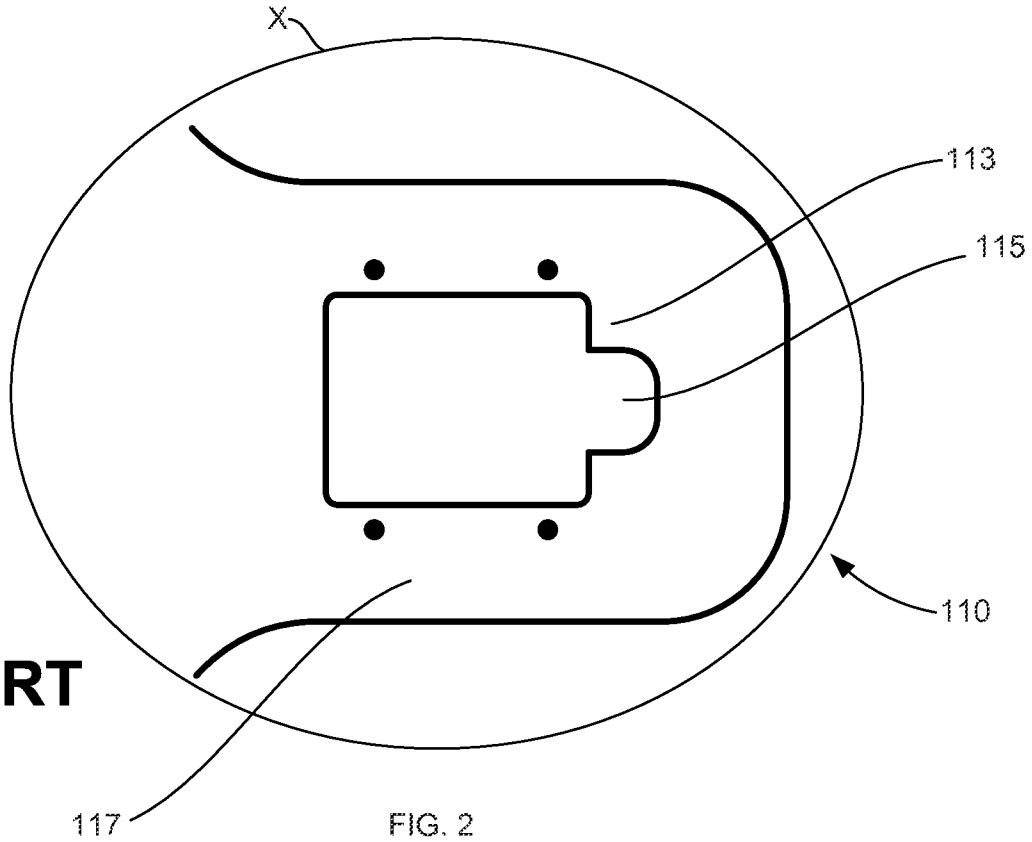
FIG. 2 PRIOR ART
FIG. 2 is an enlarged view of a portion of a deck of the skateboard, labeled as Region X in FIG. 1, illustrated with the skateboard truck removed.
Figure 3:
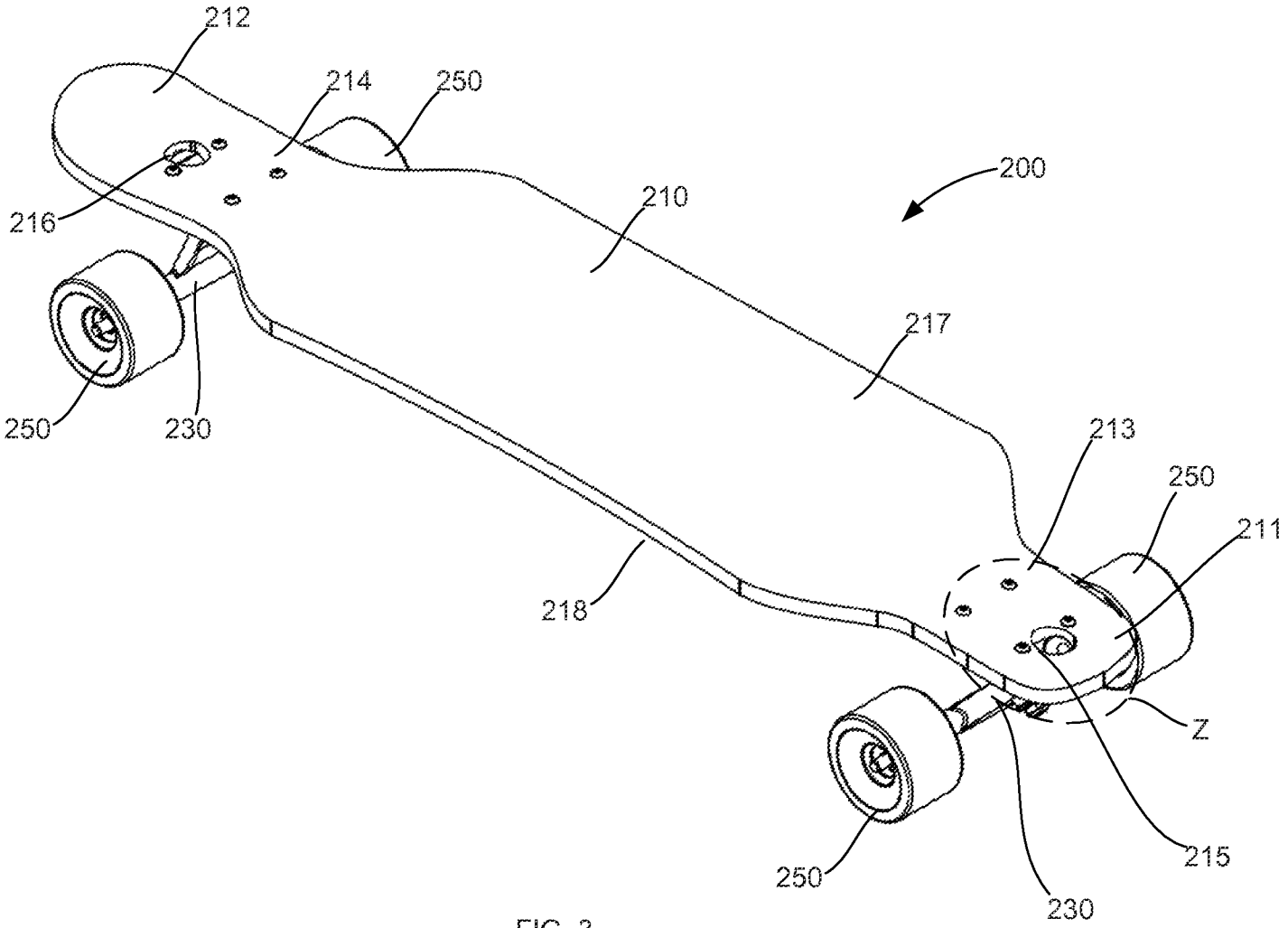
FIG. 3 is a perspective view of a skateboard, according to an embodiment.

FIG. 3 is a perspective view of a skateboard 200, according to an embodiment. The skateboard 200 includes a deck 210, a pair of trucks 230, and a set of wheels 250. The deck 210 can be any suitable shape, size, or configuration. For example, the skateboard 200, as shown in FIG. 3, is a longboard skateboard. The deck 210 includes a top surface 217 (e.g., the surface a rider stands on) and a bottom surface 218 (e.g., the surface opposite the top surface). The deck 210 further includes a first end portion 211 and a second end portion 212 configured to taper from a wider portion (e.g., toward the middle of the deck 210) to a thinner portion (e.g., toward the ends of the deck 210). In this manner, the deck 210 is configured to provide sufficient clearance for the wheels 250 such that the wheels 250 do not rub or hit the bottom surface 218 of the deck 210.

Figure 4:
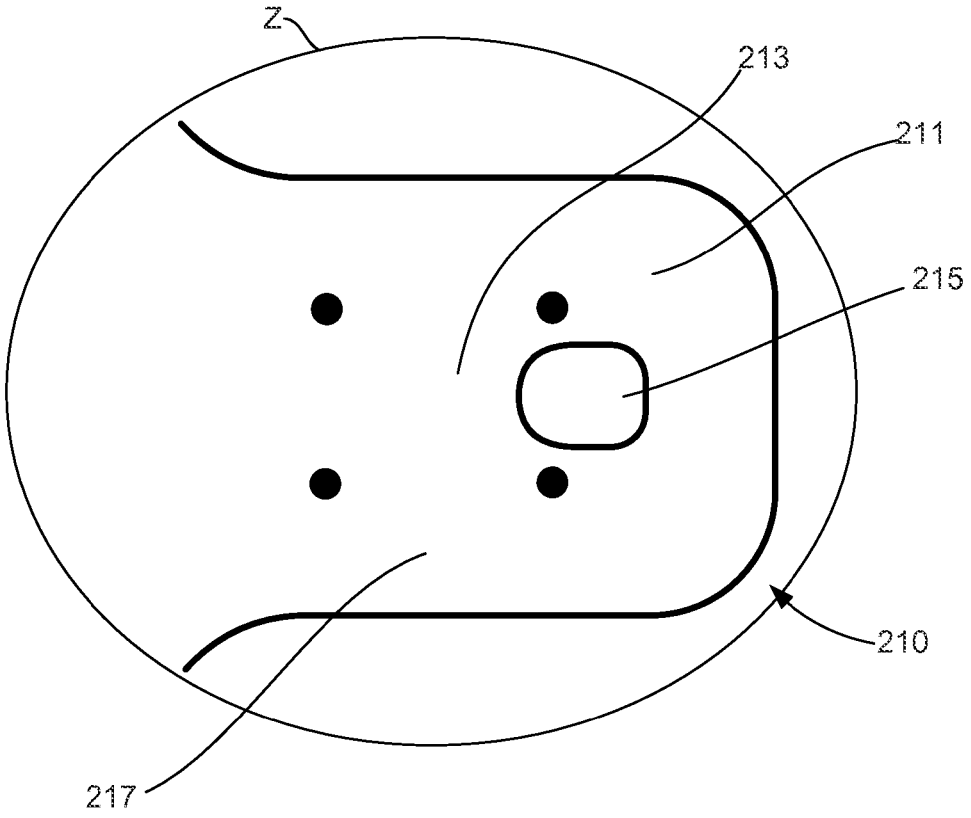
FIG. 4 is an enlarged view of a portion of the skateboard labeled as Region Z in FIG. 3, illustrated with the skateboard truck removed.

The first end portion 211 of the deck 210 includes a mounting portion 213 with an opening 215. The truck 230 is configured to be coupled to the bottom surface 218 of the deck at the mounting portion 213 via a set of fasteners (e.g., bolts, screws, etc). The opening 215, as shown in FIG. 4, is configured to receive at least a portion of a pivot cup 232 of the truck 230, as described in further detail herein. Similarly, the second end portion 212 of the deck 210 includes a mounting portion 214 that defines the opening 216. The form and function of the mounting portion 214 included in the second end portion 212 is substantially similar to the mounting portion 213 of the first end portion 211 and, therefore, is not described in detail herein.

The opening 215 can be any suitable shape or configuration, but is dimensioned to minimize the potential for exaggerated stress concentration risers. For example, in some embodiments, the opening 215 can be substantially oval, round, or oblong. In such embodiments, the opening 215 can be configured to reduce the stress concentration risers of the opening 215 within the surface of the deck 210. Thus, the opening 215 is configured to be minimal in size such that the opening 215 provides a minimal clearance between the walls defining the opening 215 and the pivot cup 234 of the truck 230, while allowing sufficient space for travel of the pivot cup 234. Additionally, the opening 215 includes corners defining relatively large radii, thereby reducing any stress concentration risers at the corners of the opening 215.

FIGS. 5-9 illustrate one of the trucks 230 included in the skateboard 200. The truck 230 included in the first end portion 211 is substantially similar to the truck 230 included in the second end portion 212. Therefore, the truck 230 shown and described in FIGS. 5-9 can be mounted to either the first end portion 211 of the deck 210 or the second end portion 212 of the deck 210.

Figure 5:
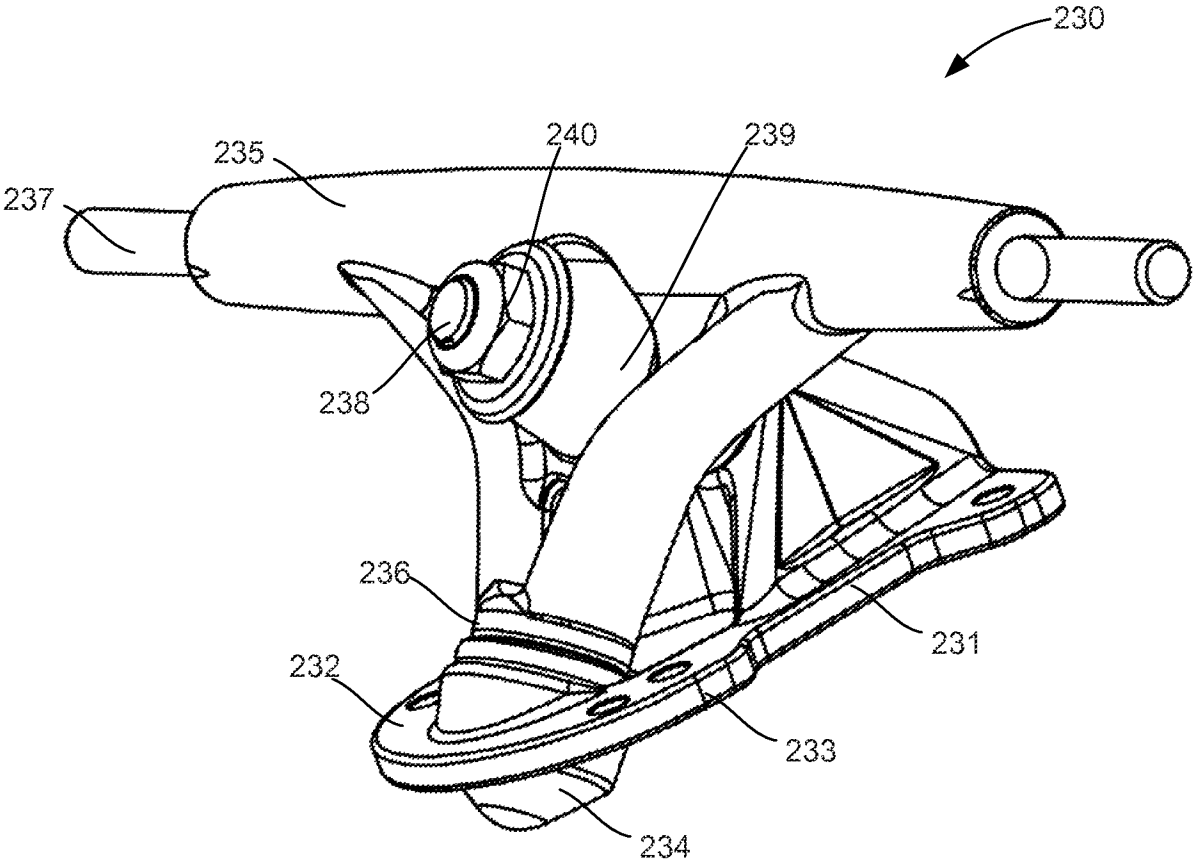
FIG. 5 is a front perspective view of a truck included in the skateboard of FIG. 3.
Figure 6:
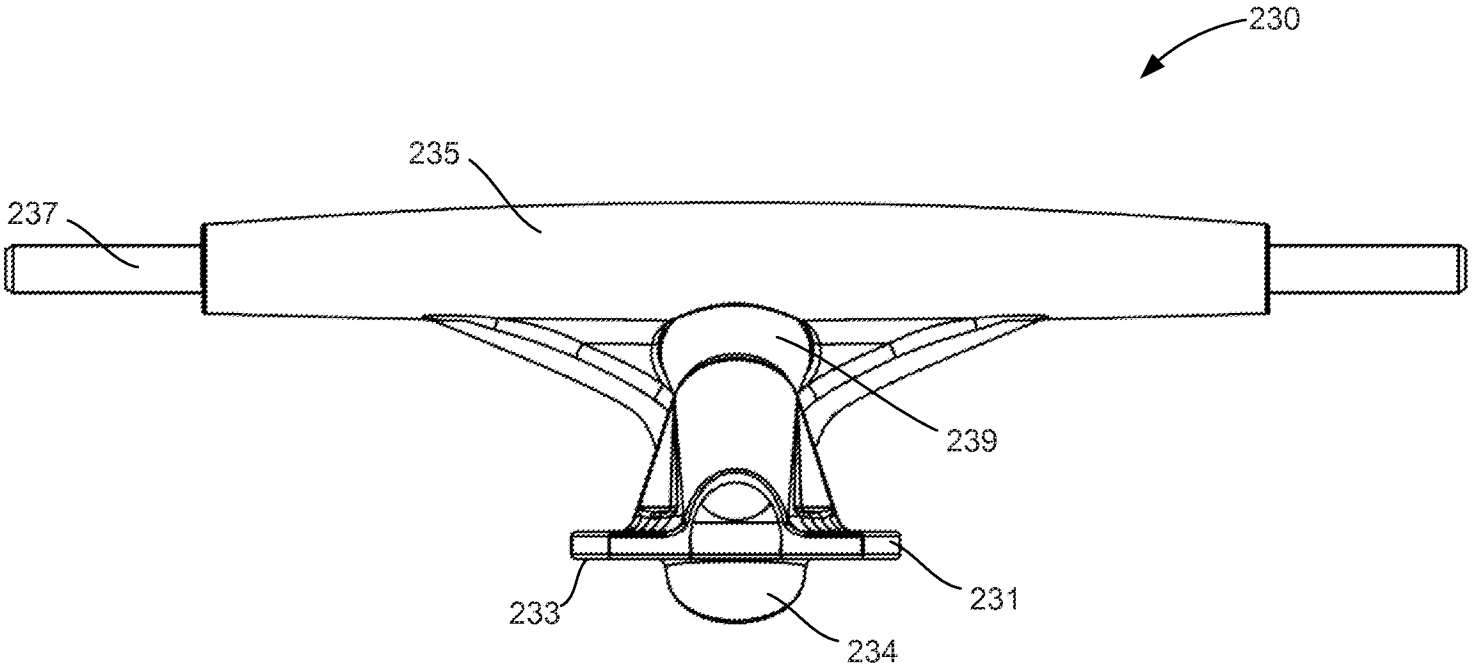
FIG. 6 is a rear view of the truck of FIG. 5.

As shown in FIG. 5, the truck 230 includes a hanger 235, the pivot cup 234, a kingpin 238, and a base plate 231. The hanger 235 includes an axle 237 and a pivot portion 236 and defines an opening 241. The axle 237 is configured to extend from the sides of the hanger 235 (FIGS. 6 and 8) and can receive a bearing included in each of the wheels 250. In this manner, the axle 237 can provide an axis about which the bearings and wheels 250 can rotate. In some embodiments, the axle is a single axle extending through the hanger 235. In other embodiments, the axle is configured as two separate components individually coupled to the hanger 235.

Figure 9:
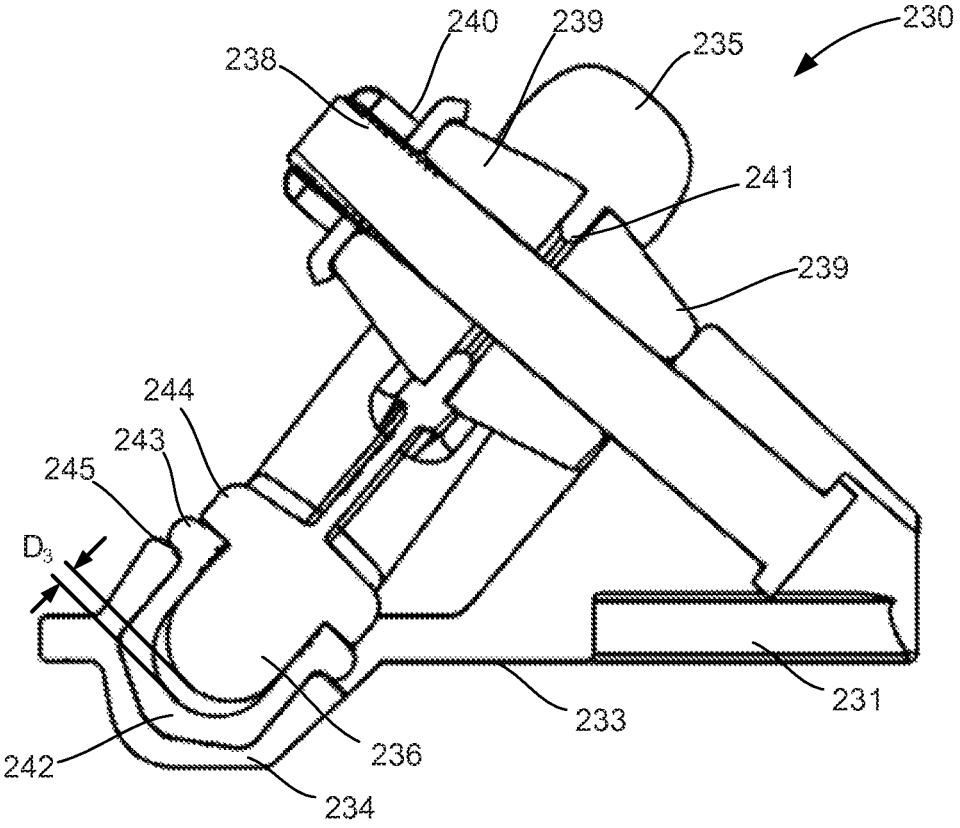
FIG. 9 is a cross-sectional view of the truck taken along the axis labeled AA in FIG. 8.

The opening 241 defined by the hanger 235 can receive the kingpin 238 (FIG. 9). More specifically, the kingpin 238 is rigidly coupled to the base plate 231 and can extend transversely from the base plate 231 at any given angle. For example, in some embodiments, the kingpin 238 extends from the base plate at 30°, 40°, 45°, 50°, 60° or any other suitable angle. In this manner, the kingpin 238 can extend from the base plate 231 and through the opening 241 defined by the hanger 235.

Figure 7:
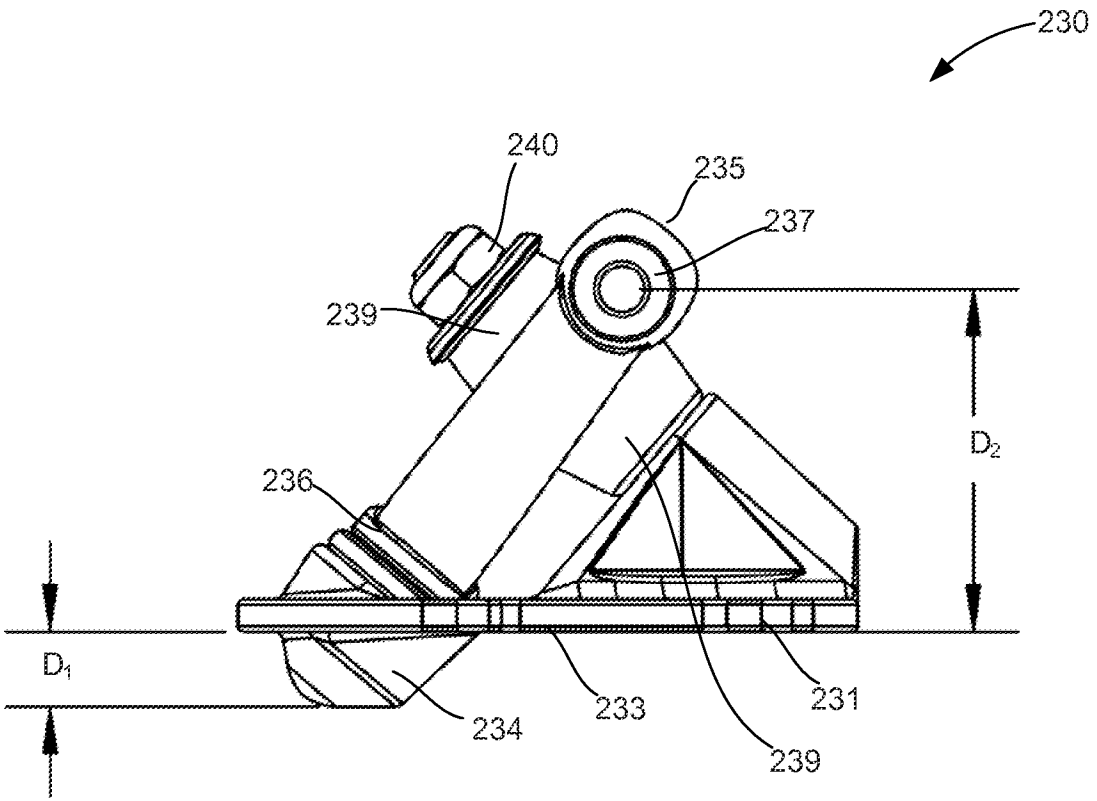
FIG. 7 is a side view of the truck of FIG. 5.
Figure 8:
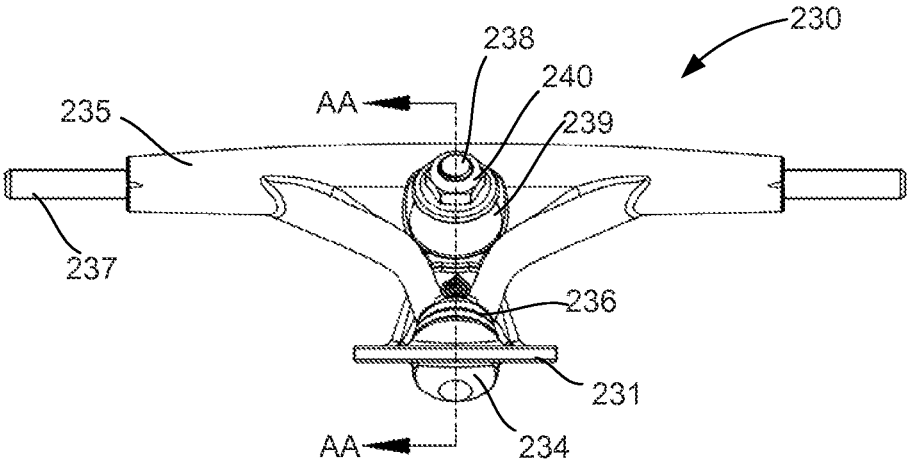
FIG. 8 is a front view of the truck of FIG. 5.

The pivot portion 236 of the hanger 235 is configured to be movably disposed within the pivot cup 234. Similarly stated, the pivot portion 236 is disposed within the pivot cup 234 such that the hanger 235 can move relative to the pivot cup 234 and about the kingpin 238. Additionally, the truck 230 includes a pair of bushings 239 disposed about the kingpin 238 configured to dampen the motion of the hanger 235. For example, as shown in FIG. 7, a first bushing 239 is disposed about the kingpin 238 between a kingpin nut 240 and a top surface of the hanger 235 and a second bushing 239 is disposed about the kingpin 238 between a bottom surface of the hanger 235 and the base plate 231. The kingpin nut 240 can be coupled to a threaded portion (not shown) of the kingpin 238, thereby engaging the bushing 239 and securing the hanger 235 to the base plate 231. In this manner, the bushings 239 engage the base plate 231, the hanger 235, the kingpin 238, and/or the kingpin nut 240 to dampen the pivot motion of the hanger 235 within the pivot cup 234 when in use.

The base plate 231 includes a first surface 232 and a second surface 233. The second surface 233 of the base plate 231 is configured to be mounted to the bottom surface 218 of the deck 210 such that the hanger 235 is positioned beneath the bottom surface 218 of the deck 210. The first surface 232 of the base plate 231 can receive a nut configured to engage a bolt that extends through the deck 210 and the base plate 231, thereby mounting the truck 230 to the deck 210. The mechanics of coupling the truck 230 to the deck 210 using bolts, screws, etc. can be similar to known bottom-mount skateboard configurations.

The pivot cup 234 included in the truck 230 is configured to extend, at least partially, beyond the second surface 233 of the base plate 231. More specifically, the pivot cup 234 can extend a first distance $D_1$ below the second surface 233 of the base plate 231, as shown in FIG. 7. For example, in some embodiments, the pivot cup 234 can extend about 10.8 mm beyond the second surface 233 of the base plate 231. In other embodiments, the pivot cup 234 can extend any suitable distance beyond the second surface 233 of the base plate 231. With the pivot cup 234 disposed, at least partially, below the second surface 233 of the base plate 231, the distance $D_2$ between the second surface 233 and the center of the axle 237 is less than with conventional bottom-mount skateboard trucks. With the pivot cup 234 disposed the distance $D_1$ beyond the base plate 231, the distance $D_2$ can be, for example, approximately 48.9 mm. In this manner, the angle between the kingpin 238 and the base plate 231 is reduced and an axis about which the hanger 235 pivots (e.g., the kingpin 238) is closer to the base plate 231, thereby increasing stability.

In some embodiments, the pivot cup 234 includes a pivot cup bushing configured as a damping suspension member 242 configured to provide suspension and dampen the motion of the pivot portion 236 within the pivot cup 234 (FIG. 9). More specifically, the damping suspension member 242 can be disposed within an opening defined by the pivot cup 234 and includes a flange 243 configured to engage an outer surface 245 of the pivot cup 234. The pivot portion 236 of the hanger 235 is configured to be disposed within the damping suspension member 242. The pivot portion 236 includes a flange 244 configured to engage the flange 243 included in the damping suspension member 242 to maintain a distance $D_3$ between an inner surface of the damping suspension member 242 and a bottom surface of the pivot portion 236 of the hanger 235. In some embodiments, for example, the distance $D_3$ can be 1 mm. In other embodiments, the distance $D_3$ can be between 0.001-10 mm. In this manner, the pivot portion 236 of the hanger 235 and the damping suspension member 242 are configured to dampen the vibration transferred from the wheels 250 rolling on a surface, to the deck 210. For example, the pivot portion 236 of the hanger 235 can travel within the damping suspension member 242 the distance $D_3$, in response to a given force (e.g., rolling over a bump, crack, and/or the like). Therefore, the damping suspension member 242 and the pivot portion 236 of the hanger 235 can allow for at least partial suspension and shock absorption and, as such, the ride quality of the skateboard 200 can be increased (e.g., the rider can experience a smoother ride).

Figure 10:
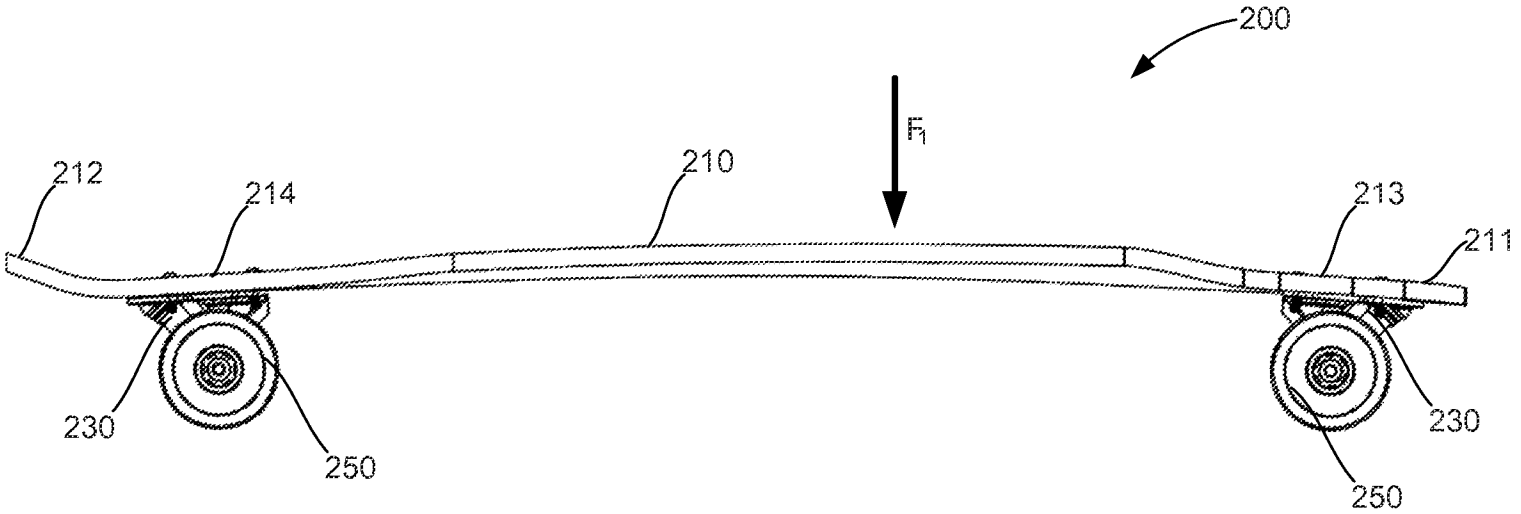
FIG. 10 is a side view of the skateboard of FIG. 3.

As shown in FIG. 10, the truck 230 can be coupled to the deck 210 at the first mounting location 213 and the second mounting location 214. The first truck 230 is coupled to the deck 210 such that the pivot cup 234 is disposed, at least partially, within the pivot cup opening 215 of the first mounting portion 213, as described above. Similarly, the second truck 230 is coupled to the deck 210 such that the pivot cup 234 is disposed, at least partially, within the pivot cup opening 216 of the second mounting portion 214. The arrangement of the pivot cups 234 within the pivot cup openings 215 and 216 allows the center of gravity of the skateboard 200 to be lower than a conventional skateboard. In this manner, the stability of the skateboard 200 is increased without the need for mounting the base plate 231 of the trucks 230 to the top surface 217 of the deck 210. Therefore, the magnitude of the stress concentration risers inherent to the opening 215 and the opening 216 in the deck 210 is reduced by defining a minimal amount of clearance between the pivot cup 234 and the walls defining the pivot cup opening 215 and the pivot cup opening 216. Additionally, with the base plate 231 of the truck 230 mounted to the bottom surface 218 of the deck 210, the bolts (not shown) configured to couple the trucks 230 to the deck 210 are not in tension when a force $F_1$ is applied (e.g., the weight of the rider). Thus, the bolts are less like likely to loosen.

Figure 11:
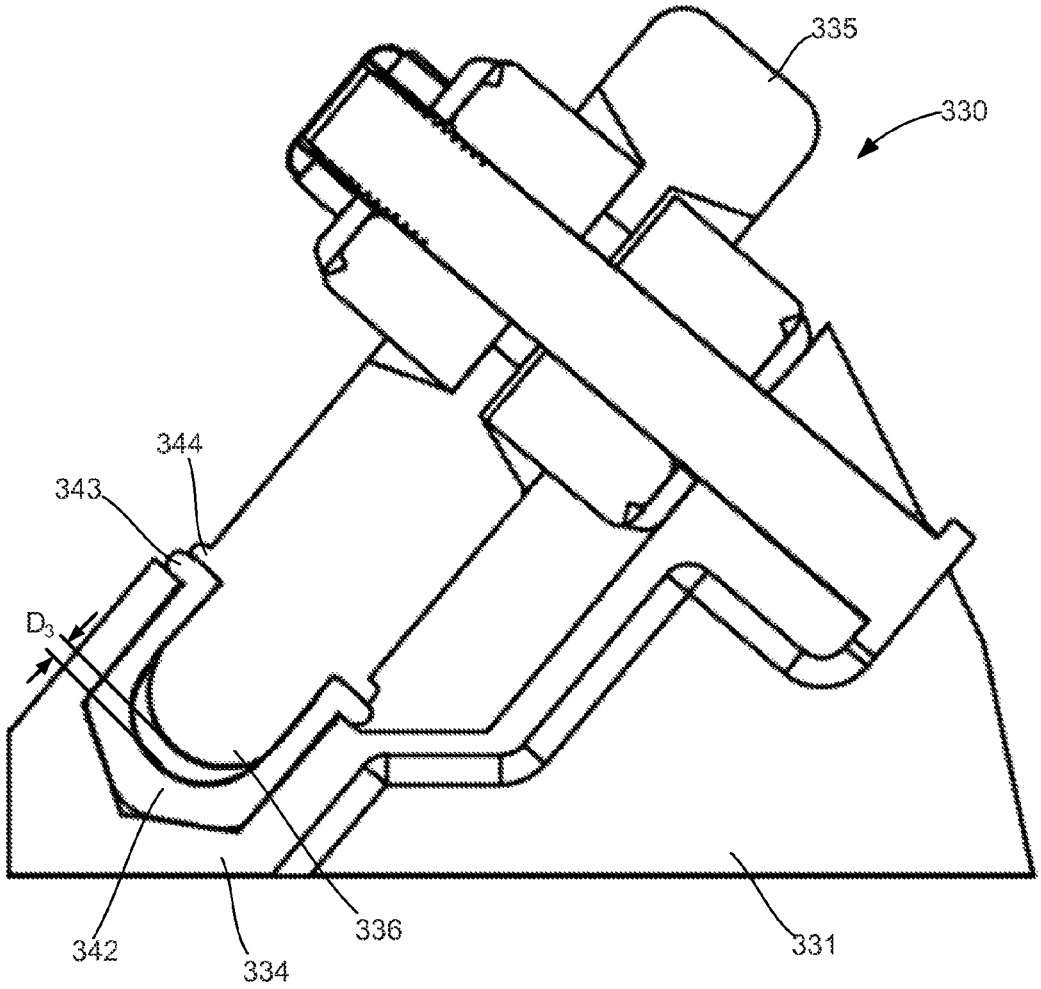
FIG. 11 is a cross-sectional view of a truck, according to an embodiment.

While the damping suspension member 242 described in reference to FIG. 9 is included in the truck 230, in some embodiments the damping suspension member 242 is integrated into any known truck configuration. For example, as shown in FIG. 11, the truck 330 includes a base plate 331 and a hanger 335 and can be configured to mount to a top surface of a skateboard. The base plate 331 includes a pivot cup 334 configured to receive a pivot portion 336 of the hanger 335. The pivot cup 334 is configured to include the damping suspension member 342 configured dampen the motion of the pivot portion 336 of the hanger 335 within the pivot cup 334, similar to the damping suspension member 242 described above in reference to FIG. 9. The damping suspension member 342 is disposed within an opening defined by the pivot cup 334 and includes a flange 343 configured to engage an edge of the pivot cup 334. The pivot portion 336 of the hanger 335 is configured to be disposed within the damping suspension member 342. The pivot portion 336 includes a flange 344 configured to engage the flange 343 included in the damping suspension member 342 to maintain a distance $D_3$ between an inner surface of the damping suspension member 342 and a bottom surface of the pivot portion 336 of the hanger 335. In this manner, the damping suspension member 342 can be included in known truck configurations to reduce vibrations transferred to the deck. Similarly stated, the use of the damping suspension member 342 shown and described herein is not limited to a truck including the dropped pivot cup design.

While the damping suspension member 242 described with respect to FIG. 9 is shown as being substantially cup-shaped, in some embodiments the damping suspension member 242 can be any shape, form, or configuration. For example, in some embodiments, a damping suspension member can be an o-ring disposed between the outer surface 245 of the pivot cup 234 and the flange 244 of the pivot portion 236. In other embodiments, the damping suspension member can be a wave spring, leaf spring, linear spring, and/or any other suitable suspension member. In such embodiments, the damping suspension member is substantially outside the pivot cup 234, but disposed between the pivot portion 236 and the pivot cup 234.

While the pivot cup 234 described with respect to FIG. 7 is shown as being monolithically formed with the base plate 231, in some embodiments, the pivot cup 234 can be formed independently from the base plate 231. For example, in some embodiments, the base plate can be formed an aluminum alloy and the pivot cup can be formed from any suitable metal or metal alloy. In such embodiments, the pivot cup can be coupled to the base plate in any suitable manner, such as, for example, welded. Furthermore, the material used to form the pivot cup can be such that the pivot cup can function as a damping suspension member. For example, the pivot cup can be formed from a metal alloy or other material configured to elastically deform and/or absorb shock. In this manner, the pivot cup can function as a damping suspension member such that no additional suspension member is required (e.g., the damping suspension member 242).

While various embodiments have been described above, it should be understood that they have been presented by way of example only, and not limitation. Where schematics and/or embodiments described above indicate certain components arranged in certain orientations/or positions, the arrangement of components may be modified. Similarly, where methods and/or events described above indicate certain events and/or procedures occurring in certain order, the ordering of certain events and/or procedures may be modified. While the embodiments have been particularly shown and described, it will be understood that various changes in form and details may be made.

Although various embodiments have been described as having particular features and/or combinations of components, other embodiments are possible having a combination of any features and/or components from any of embodiments as discussed above.

The invention claimed is:

1. A skateboard truck, comprising:

a base plate having a first surface and a second surface, the second surface configured to be coupled to a surface of a skateboard deck that defines a deck opening, the base plate including a pivot cup extending from the second surface, at least a portion of the pivot cup being disposed in the deck opening when the base plate is coupled to the skateboard deck;

a kingpin coupled to the base plate; and a hanger having an axle and a pivot portion, the pivot portion configured to engage the pivot cup, the hanger defining a hanger opening configured to receive at least a portion of the kingpin to couple the hanger to the base plate, the hanger configured to pivot relative to the kingpin when the hanger is coupled to the base plate.

2. The skateboard truck of claim 1, further comprising:

a damper disposed between the pivot cup and the pivot portion.

3. The skateboard truck of claim 1, wherein the kingpin is disposed at an acute angle relative to the second surface.

4. The skateboard truck of claim 1, wherein the kingpin and the second surface define an angle between about 30 degrees and about 70 degrees.

5. The skateboard truck of claim 1, wherein the pivot portion of the hanger is disposed in the pivot cup such that at least a portion of the pivot portion is partially disposed beyond the second surface.

6. The skateboard truck of claim 1, wherein the pivot cup defines an inner surface, the pivot portion of the hanger being disposed in the pivot cup such that an end surface of the pivot portion of the hanger is spaced apart from the inner surface.

7. The skateboard truck of claim 1, wherein the hanger opening and the kingpin collectively configured to allow the hanger to pivot relative to the kingpin.

8. The skateboard truck of claim 1, wherein the hanger opening and the kingpin are collectively configured to allow the hanger to pivot relative to the kingpin, the skateboard truck further comprising:

a first bushing being disposed about a first portion of the kingpin and on a first side of the hanger; and a second bushing being disposed about a second portion of the kingpin and on a second side of the hanger opposite the first side, the first bushing and the second bushing configured to dampen the pivot motion of the hanger relative to the kingpin.

9. A method, comprising:

coupling a first end portion of a kingpin to a base plate having a first surface and a second surface different from the first surface, the base plate including a pivot cup extending from the first surface, the first surface configured to be placed in contact with a skateboard deck, the kingpin configured to extend from the second surface;

inserting at least a portion of the kingpin through a hanger opening defined by a hanger, the hanger including a pivot portion and an axle;

positioning the hanger relative to the base plate and along the kingpin to at least partially dispose the pivot portion in the pivot cup and beyond the first surface of the base plate; and coupling a fastener to a second end portion of the kingpin, opposite the first end portion, to couple the hanger to the base plate.

10. The method of claim 9, further comprising:

disposing a damper between the pivot portion of the hanger and the pivot cup of the base plate prior to positioning the hanger.

11. The method of claim 9, wherein the first surface of the base plate is configured to be placed in contact with the skateboard deck such that the pivot cup is at least partially disposed in a deck opening defined by the skateboard deck.

12. The method of claim 9, wherein the pivot cup includes an inner surface, the positioning of the hanger relative to the base plate and along the kingpin includes disposing the pivot portion in the pivot cup such that an end surface of the pivot portion is spaced apart from the inner surface of the pivot cup.

13. The method of claim 9, further comprising:

disposing a first bushing about a first portion of the kingpin prior to inserting at least the portion of the kingpin through the hanger opening, the positioning the hanger relative to the base plate and about the kingpin includes placing a first surface of the hanger in contact with the first bushing; and disposing a second busing about a second portion of the kingpin after inserting at least the portion of the kingpin through the hanger opening, the second bushing being in contact with a second surface of the hanger opposite the first surface of the hanger when the hanger is positioned about the kingpin.

14. An apparatus, comprising:

a skateboard deck having a first surface and a second surface, and defining a deck opening; and a truck assembly having a base plate, a kingpin coupled to the base plate, and a hanger, the base plate including a pivot cup, the base plate coupled to the second surface of the skateboard deck such that at least a portion of the pivot cup is disposed within the deck opening, the hanger including an axle and a pivot portion, and defining a hanger opening, the pivot portion being at least partially disposed in the pivot cup of the base plate, a portion of the kingpin disposed within the hanger opening, an end portion of the kingpin coupled to a fastener to couple the hanger to the base plate.

15. The apparatus of claim 14, wherein the hanger opening and the kingpin are collectively configured to allow the hanger to pivot relative to the kingpin.

16. The apparatus of claim 14, wherein the base plate includes a mounting surface in contact with the second surface of the skateboard deck, the portion of the pivot cup is a first portion of the pivot cup disposed on a first side of the mounting surface, the pivot cup including a second portion disposed on a second side of the mounting surface.

17. The apparatus of claim 14, wherein the portion of the pivot cup is disposed in the deck opening such the portion is between the first surface of the skateboard deck and the second surface of the skateboard deck.

18. The apparatus of claim 14, wherein the base plate includes a mounting surface in contact with the second surface of the skateboard deck, the kingpin being disposed at an acute angle relative to the mounting surface.

19. The apparatus of claim 14, wherein the base plate includes a mounting surface in contact with the second surface of the skateboard deck, the mounting surface having at least one dimension greater than a width of the deck opening.

20. The apparatus of claim 14, the hanger opening and the kingpin are collectively configured to allow the hanger to pivot relative to the kingpin, the truck assembly including a first bushing and a second bushing, the first bushing being disposed about a first portion of the kingpin and on a first side of the hanger, the second bushing being disposed about a second portion of the kingpin and between the fastener and a second side of the hanger opposite the first side, the first bushing and the second bushing configured to dampen the pivot motion of the hanger relative to the kingpin.

* * * * *